United States Patent [19]

Sliwinski et al.

[11] Patent Number: 4,730,954

[45] Date of Patent: Mar. 15, 1988

[54] GROUND TREATMENT

[75] Inventors: Ziemowit J. Sliwinski, London; Wilfred G. K. Fleming, Chorleywood, both of England

[73] Assignee: Cementation Piling & Foundations Limited, United Kingdom

[21] Appl. No.: 914,378

[22] Filed: Oct. 2, 1986

[51] Int. Cl.[4] ..... E02D 3/08; E02D 5/38

[52] U.S. Cl. ..... 405/240; 405/229; 405/232; 405/243

[58] Field of Search ..... 405/233, 232, 240, 243, 405/248, 229

[56] References Cited

U.S. PATENT DOCUMENTS

| | | | |
|---|---|---|---|
| 1,887,630 | 11/1932 | Frankignoul . | |
| 2,649,694 | 8/1953 | Pickman | 405/248 X |
| 3,406,524 | 10/1968 | Blenkarn et al. | 405/248 |
| 4,384,809 | 5/1983 | Rusche | 405/240 |
| 4,575,283 | 3/1986 | Guandalini et al. | 405/240 |

FOREIGN PATENT DOCUMENTS

| | | |
|---|---|---|
| 350934 | 1/1961 | Switzerland . |
| 664854 | 1/1952 | United Kingdom . |
| 1133952 | 11/1968 | United Kingdom . |
| 1430159 | 3/1976 | United Kingdom . |

*Primary Examiner*—David H. Corbin
*Attorney, Agent, or Firm*—Arnold S. Weintraub

[57] ABSTRACT

Apparatus for forming a stone column in the ground is disclosed. The apparatus comprises a pair of concentric tubes (2,3) the inner one (2) of which is open at both ends, and at or near its lower end may be connected to the outer tube (3) by an outwardly extending wall portion (4). A driving plate (14) is attached at or close to the upper end of one of said inner and outer tubes, so as to extend around said one tube, so that the apparatus may be driven into or against the ground. In a preferred embodiment, the lower portion of the inner tube (2), the outwardly extending wall portion (4) and the lower portion of the outer tube (3) together define a cavity comprising an upper, relatively narrow portion (7) and a lower, relatively wide portion (9). A method of forming a stone column using the apparatus is also disclosed. After driving the apparatus into the ground, it is withdrawn in stages, after each of which a compacting force is applied in order to consolidate the stone column. By accentuating these compaction forces or their duration, it is possible to produce localized bulges along the stone column.

In a modification, the method of the invention is used to form cast-in-place piles without the use of a pile shoe.

16 Claims, 5 Drawing Figures

GROUND TREATMENT

BACKGROUND OF THE INVENTION

This invention relates to ground treatment and, more particularly, is concerned with strengthening ground of otherwise inadequate load bearing capacity by the formation therein of stone columns.

There are two well known methods for the formation of stone columns in the ground in order to provide support for buildings. These are both methods of ground improvement rather than of piling since the strength of each column is derived from lateral soil reaction around the column, and they are normally applied to cohesive ground or "fill" soils rather than to cohesionless soils since these latter soil types may in general more readily be compacted by the use of heavy vibrator equipment to increase their strength.

The most common of the known methods is to use a special vibrator, sometimes known as a Vibroflot, which expels water or air from its body as it sinks into the ground, thus forming a hole. The hole is then filled with stone and the stone is compacted into the ground in stages using the vibrator. Thus a stone column is formed in the ground which serves to strengthen it and which also provides a drainage path which is beneficial to the rapid consolidation of the ground as structural loads are subsequently applied.

The second known method is to drive a tube into the ground using a gravel plug in the base or the tube upon which acts a hammer which is raised and dropped within the body of the tube. When the tube has been driven to a desired depth it is then held in a fixed position by wire ropes, while the plug is expelled by further driving. Subsequently, a stone is placed within the tube and compacted by the hammer, the tube is withdrawn so that finally a stone column is formed in the ground. This stone column acts in the same manner as described above for the case where a vibrator is used in its insertion.

There are some disadvantages attached to both these methods in that, in wet ground conditions when using the vibrator-based method, the bore hole formed must be kept full of water which involves the displacment of significant amounts of water onto the site; while, in the case of the driven-tube methods, the driving forces needed to expel the plug are high and involve considerable forces on the equipment during the plug ejection and tube withdrawal.

SUMMARY OF THE INVENTION

According to one aspect of the present invention, there is provided apparatus for forming a stone column in the ground, which comprises a pair of concentric tubes the inner one of which is open at its upper end, and at or near its lower end is connected to the outer tube; and a driving plate attached at or close to the upper end of one of said inner and outer tubes, so as to extend around said one tube, by means of which driving plate the apparatus may be driven into or against the ground, wherein the space within said inner tube defines a cavity for receiving stone.

DESCRIPTION OF THE PREFERRED EMBODIMENTS

In one embodiment, the inner tube is open at both ends. Also, the inner tube may be connected to said outer tube by a rigid outwardly extending wall portion; this outwardly extending wall portion, that part of said inner tube at the lower end thereof and that portion of said outer tube at the lower end thereof may together define said cavity which will thus comprise an upper, relatively narrow portion and a lower, relatively wide portion.

Alternatively, said inner tube is closed at its lower end, e.g. by a metal or wooden plate.

According to a second aspect of the present invention, there is provided an apparatus for forming a stone column in the ground, which comprises a pair of concentric tubes the inner one of which is open at both ends, and at or near its lower end is connected to the outer tube by an outwardly extending wall portion; a driving plate attached at or close to the upper end of one of said inner and outer tubes, so as to extend around said one tube, by means of which driving plate the apparatus may be driven into or against the ground; wherein the lower portion of said inner tube, said outwardly extending wall portion and the lower portion of said outer tube together define a cavity comprising an upper, relatively narrow portion and a lower, relatively wide portion.

There may be a tapered or frustoconical cavity portion which diverges in the downward direction between the upper and lower portions—i.e. the outwardly extending wall portion may comprise a downwardly and outwardly inclined portion. In one embodiment, the lower, relatively wide portion of the inner cavity is delineated entirely by an inclined wall extending between the inner tube and the outer tube.

Preferably the driving plate is attached to the upper end of the outer tube.

The inner tube and the outer tube will be formed of a rigid material capable of withstanding the forces involved in driving the tubes downwardly into the ground.

In one embodiment, the inner tube extends above the level of the driving plate by a distance equivalent to the stroke of a hammer which is to be used to insert the tubes into the ground; preferably, the uppermost portion of the inner tube has fixed about it an extraction plate for use in withdrawing the apparatus from the ground.

In another embodiment, the outer tube extends upwardly beyond the level of the inner tube; in this embodiment, there may be an upper wall connecting the top of the inner tube to the outer tube or extending from the inner tube across the annular gap towards the outer tube. With such an arrangement, there will be an extension of said cavity in the form of an uppermost region which is wider than the upper, relatively narow portion and which may serve as a reservoir for stone which is to be used in forming the stone column. Where the outer tube is longer than the inner tube, the outer tube will advantageously have fixed to it an extracting plate.

The inner and outer tubes may be interconnected at the level of the driving plate, as well as by means of the outwardly extending wall portion close to the base of the apparatus. Means for admitting stone to the interior of the apparatus may be provided at or close to the top of the apparatus and may be disposed centrally, so as to feed stone into the internal cavity directly, or at the side, so as to feed stone into said cavity via a duct and/or a reservoir for stone.

Most conveniently, the inner and outer tubes are circular in cross-section. Other tube forms, for example of square section, may be used if desired.

The diameter of the outer tube will determine the width of a stone column produced by the apparatus. Typically, this will be in the range 500 to 900 mm. The overall length of the inner and outer tubes will determine the maximum depth of stone column which can be formed with the apparatus; such columns typically will have a depth in the range from 2 to 15 meters.

The structure of the apparatus at the lower end of the inner and outer tubes is such that, by virtue of the joining together of the inner and outer tubes through the outwardly extending wall portion, stone is held between the ground reaction force and the pressure of stone within the lower region of the inner tube so that the stone forms or behaves as an arch. Thus no driving shoe is necessary to close off the base of the inner tube although if desired a closing plate may be used across the bottom of the inner tube. Such a closing plate would be an alternative to building up any stone pressure across the bottom of the inner tube; and the plate, which itself may be either flat or domed in shape, would be expendable. It could be made of steel or of any other suitable material such as a rigid synthetic polymer or concrete. It is, however, advantageous to be able to dispense with a driving shoe.

The apparatus of this invention may incorporate a hammer located above said driving plate. Where the inner tube extends upwardly through a driving plate attached at or near the top of the outer tube, the hammer may be annular and can be located around the upper portion of said inner tube. Such an annular hammer may slide over the outer surface of the upper part of said inner tube above the level of the driving plate. Conveniently in such an embodiment, the uppermost part of the inner tube will have an annular extraction plate attached thereto so that upward movement of the hammer against the extraction plate can be used to withdraw the apparatus from the ground, while downward movement of the hammer against the driving plate is used for inserting the apparatus into the ground. The hammer may be motivated to act in the downward or in the upward and downward directions by any suitable means, for example by its own weight, (for downward action) or by compressed air, or hydraulic or electrical power. When a simple drop hammer is used, the whole system may be suspended from a crane.

Where the outer tube extends upwardly beyond the upper limit of the inner tube, a hammer of conventional form may form a part of, or be used in conjunction with, the apparatus of this invention; and lateral lugs or arms may be provided for use in extracting the apparatus from the ground.

In use, the apparatus will be supported and located by a suitable arrangement which will generally be placed on the ground around the apparatus itself.

The inner tube may be of constant cross-section along its length, or alternatively, it may be slightly tapered beween its bottom end and the head of the outer tube, being wider at the base, in order to permit thereby the easy downward movement of stone and to prevent any jamming of stone within the inner tube during use of the apparatus. With the same object in mind, a vibrator may be attached to or form part of the apparatus; such a vibrator may act upon the outer wall of the inner tube, or upon the inner or outer wall of the outer tubes.

In use, a small heap of stone may be located on the ground surface at the position where a stone column is to be formed, and the apparatus of the invention then lowered on top of this heap. Further stone may be added through the inner tube if desired, but not necessarily sufficient to fill the inner tube. The apparatus is then driven into the ground by suitable means acting on the driving plate (generally carried by the outer tube). When the apparatus has reached the depth required in accordance with structural design requirements for the site undergoing treatment, further stone is provided through the top of the inner tube and the apparatus is extracted in a plurality of short upward movements. This may be achieved by means of an annular hammer acting between the driving plate of the apparatus and an extraction plate positioned about the top of said inner tube. At each stage, the hammer may advantageously be used again in its downward mode of operation in order to compact the stone which has just been expelled from the lower end of the concentric tubes. The force of such compaction tends to re-form an arch of stones in the lower part of the cavity of the apparatus, and if downward driving is maintained or continued it is possible to create a bulbous section or a bulge between the ends of the stone column. The extraction/compaction cycle is repeated until the apparatus reaches ground level, at which time the stone column is complete. As well as ensuring that the stone is compacted, it is thus possible to form a stone column having one or several bulbous regions along its length. After reaching ground level, the apparatus may be moved to the next required position.

According to another aspect of the present invention, there is provided a method of forming a stone column, which comprises positioning an apparatus as defined hereinabove at a location where a stone column is to be formed; pre-positioning stone at said location before positioning the apparatus, or adding stone to the interior cavity of the apparatus after it has been positioned at said location; driving the apparatus downwardly to a depth equivalent to the desired depth for the stone column which is to be formed; and thereafter extracting the apparatus in a plurality of stages while delivering stone through the inner tube of the apparatus, and applying to the apparatus between each of the removal stages during extraction a downward force in order to compact stone expelled from the lower end of the apparatus.

Stone may be supplied continuously to the top of the inner tube during the extraction phase. In one embodiment, stone is supplied by a compressed air feeding system; in this embodiment, a small quantity of cement may be blown in with the stone over the whole or over a part of the length of the column in order to enhance the strength of the material forming the column. This may be beneficial, particularly in the upper part of the stone column where the lateral earth confining pressures are least. At any stage in the construction of a stone column, the supply of stone may be discontinued and replaced by a supply of concrete so that the remainder of the column is formed of concrete as would be the case for a cast-in-place pile. Dry concrete may be used instead of stone in part or parts of the column; or a mixture of stone and dry concrete may be used.

A further use of the principle may be made in the construction of driven cast-in-place piles. Instead of stone being the material used to form the arch at the base of the driving tube, a dry concrete or one containing only a small quantity of water (low water/cement ratio) may be used. A predetermined quantity of such material may be placed within the inner tube followed by other concrete of the same dry mix or by concrete of the normal wet mix, as commonly used in cast-in-place concrete piles or by a cementitious grout. The tube is then driven to the required pile depth and by a sequence of withdrawal and re-driving movements as described above a bulge or bulb of concrete may be formed in the ground to make an enlarged pile foot. Similar enlargement of the pile section may be undertaken at other levels in the ground as the pile is formed if required. Accordingly, in another aspect the invention provides a method of forming a cast-in-place pile without the use of a pileshoe, which comprises positioning an apparatus as defined hereinabove at a location where a pile is to be formed; pre-positioning dry or nearly dry concrete at said location before positioning the apparatus, or adding dry or nearly dry concrete to the interior cavity of the apparatus after it has been positioned at said location; driving the apparatus downwardly to a depth equivalent to the desired depth for the pile which is to be formed; and thereafter extracting the apparatus in a plurality of stages while delivering dry or nearly dry concrete through the inner tube of the apparatus, and applying to the apparatus between each of the removal stages during extraction a downward force in order to compact the concrete expelled from the lower end of the apparatus. The term "nearly dry concrete" as used herein means concrete having a low water/cement ratio.

The remainder of the pile may be formed by pouring concrete into the inner tube as necessary during the withdrawal stage in order to form a complete concrete pile to the required finishing level. The pile may be reinforced by a steel bar or bars which can be inserted into the inner tube during the withdrawal stage or alternatively a steel reinforcement cage may be inserted into the wet concrete after the final withdrawal of the driving tube. When a wet or workable concrete is used during the withdrawal stage it is not generally necessary to compact it by tamping blows from the hammer during withdrawal, although this may be done if desired.

By using a sealing system, such as a plug attached to the driving helmet on the pile head or by any other closure device or valve near the tube top, and by connecting a concrete pump feed to the inner tube, pressure may be maintained at any desired level within the inner tube during withdrawal, thus obviating any possibility of reduction of the pile section of 'necking' which may be a risk in some very soft or peaty soils.

The present invention is advantageous because of its speed of operation, the assurance of the quantity of stone used in each stone column, and the freedom from the use of water in the installation process.

BRIEF DESCRIPTION OF THE DRAWINGS

For a better understanding of the invention, and to show how the same may be carried into effect, reference will now be made, by way of example, to the accompanying drawings, in which:

Referring to FIG. 1 of the drawings, the apparatus indicated generally at 1 comprises an inner tube 2 positioned coaxially within an outer tube 3. The lowermost end of inner tube 2 is connected to outer tube 3 by means of a downwardly and outwardly inclined wall portion 4. This extends around the entire periphery of inner tube 1 and, together with the lowermost portion 5 of tube 2 and the lowermost postion 6 of tube 3, defines a cavity comprising an upper, relatively narrow cylindrical portion 7; an intermediate, frustoconical portion 8; and a lower, relatively wide cylindrical section 9. As shown in the drawing, the apparatus is placed over a heap of stone 10 positioned on the ground 11. The uppermost part 12 of tube 3 is connected to tube 2 by a wall portion 13. Wall 13 also carries a driving plate 14 which extends about tube 2 as shown. The driving plate 14 can be carried by radial stiffeners welded both to plate 14 and to wall portion 13. An extraction plate 15 is positioned about the uppermost region 16 of tube 2. An annular hammer 17 is located between driving plate 14 and extraction plate 15. Hammer 17 is suspended from a yoke 18 by suspending ropes 19 which pass through holes provided in extraction plate 15.

Figure 1:
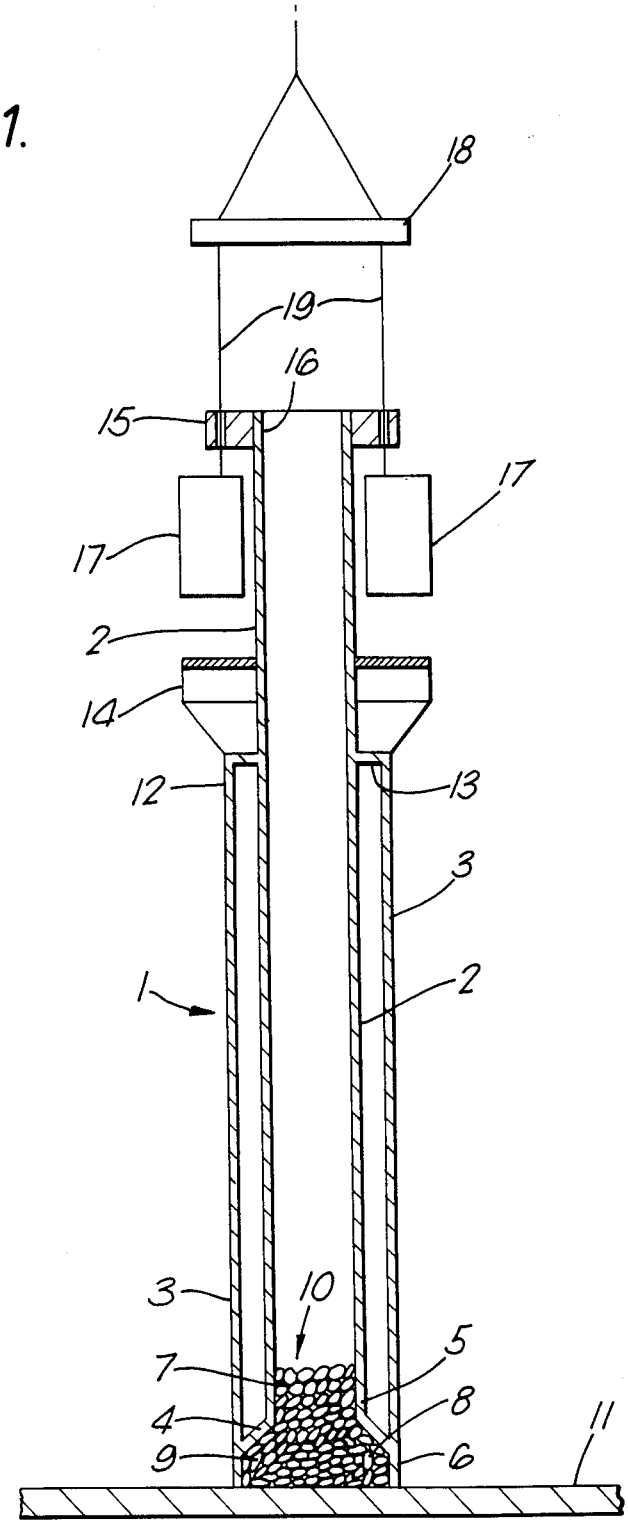
FIG. 1 shows a schematic cross-section through a first embodiment of apparatus in accordance with the invention at the start of an operation to form a stone column.

In use, the entire apparatus is suspended from a crane (not shown). Means for delivering stone (not shown) to the upper part 16 of tube 2 is also provided. At the outset, with the apparatus positioned as shown, hammer 17 is used to drive the apparatus into the ground by repeated loads on driving plate 14. When the apparatus has reached the required depth, delivery of stone to the interior of tube 2 is commenced and hammer 17 is used to withdraw the apparatus from the ground by repeated blows against extraction plate 15. After each phase of extraction, hammer 17 is driven against plate 14 so as to compact stone which has just been expelled from lower end 6 of the apparatus. Thus hammer 17 alternately strikes extraction plate 15 and driving plate 14 during the extraction phase. The rate of delivery of stone may be selected so as to correspond with the average extraction rate of the apparatus. Stone delivery is stopped when the lower end 6 of the apparatus approaches ground level 11. At the end of a stone column-forming operation, the apparatus may be speedily removed to the next location at which a stone column is to be formed.

Figure 2:
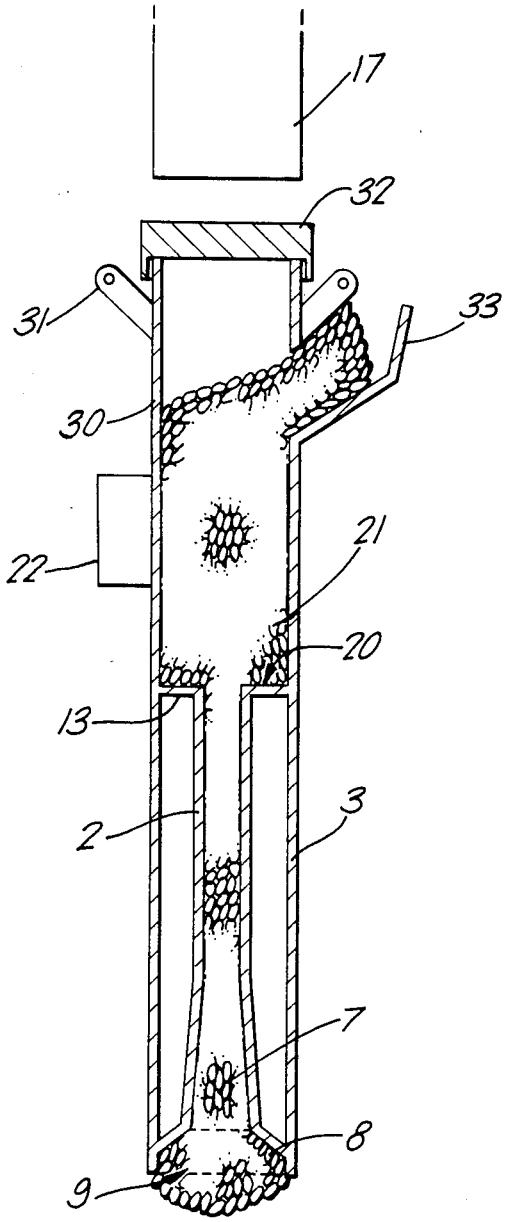
FIG. 2 shows schematically a second embodiment of apparatus in accordance with the invention.

Referring now to FIG. 2, an alternative embodiment of apparatus is illustrated in which the outer tube 3 extends upwardly beyond the upper limit 20 of inner tube 2. The upper section 30 of tube 3 carries extraction lugs 31 and a cylindrical driving plate 32, as well as a lateral hopper 33 for feeding stone into the apparatus. The region 21 within the outer tube 3 above the limit 20 of inner tube 2 acts as a reservoir for stone which, in use, passes into the upper relatively narrow portion 7 of the interior cavity and thence to the lower parts 8 and 9 of the cavity. A vibrator shown schematically at 22 is operatively attached to the exterior of wall portion 30 to encourage free flow of stone downwardly through the apparatus.

Figure 3:
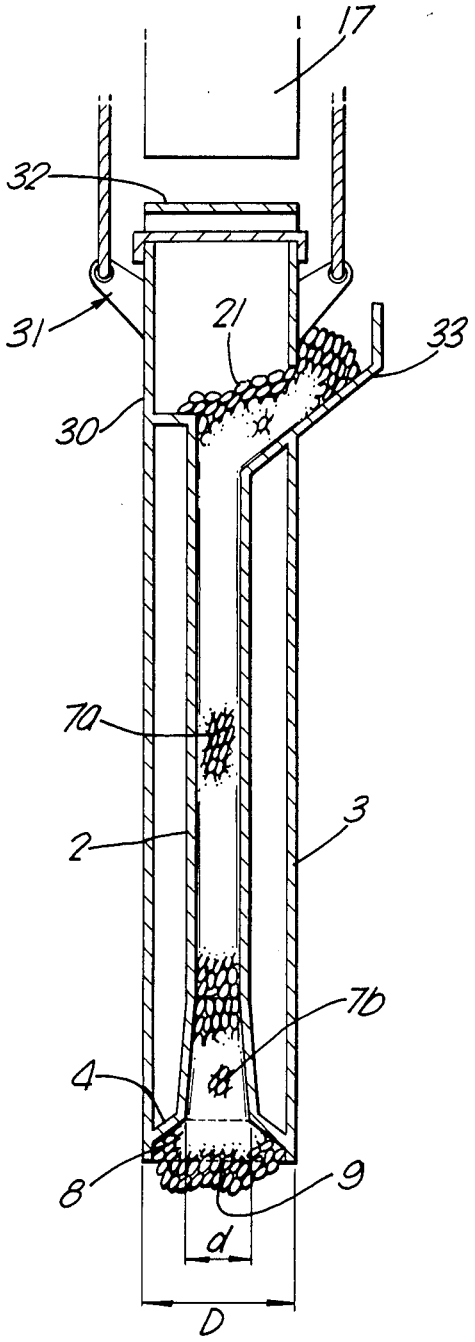
FIG. 3 shows schematically a modification of the apparatus of FIG. 2.

Referring now to FIG. 3, there is shown a modification of the apparatus of FIG. 2 in which the size of reservoir 21 is much reduced, and in which the upper, relatively narrow portion of the cavity within the inner tube 2 comprises two sections—an upper, cylindrical section *7a* occupying most of the region 7 and a lower, downwardly and outwardly flared section *7b*. The difference between the internal diameter, d, of the inner tube 2 and the diameter, D, of the outer tube 3 has been exaggerated for ease of depiction.

For optimal operation, stone in the regions 8 and 9 must lock together, under the force of compaction applied by hammer 17, so as to act as an arch of friction material located against cross-wall 4 and bridging across the cavity at the level of wall 4. Hence the ratio d/D must not be too large, and the mean diametrical dimension of the stone must not be too small relative to d. In one specific construction, of the type shown in FIG. 3, the value of D was 570 mm and the value of d was 400 mm. The taper section 8 was 135 mm in vertical extent, and the secondary taper section *7b* was 865 mm in vertical extent. Cylindrical section *7a* was 2.5 m high. This apparatus worked extremely well in a series of tests using different stone, the mean diameter of the finest stone used being 25 mm and the mean diameter of the coarsest stone used being 100 mm. Such a structure, however, is not essential since effective working can be achieved with apparatus constructed relatively more simply, as will be apparent from the following.

Figure 4:
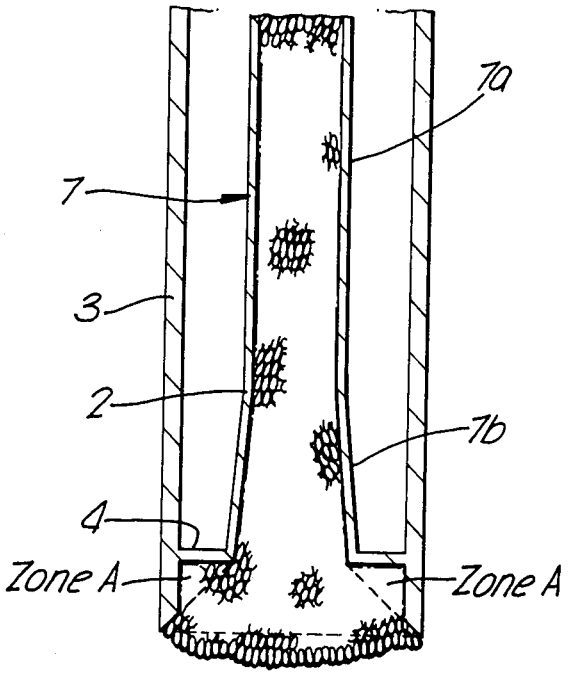
FIG. 4 illustrates an alternative form of construction of the lowermost part of the apparatus shown in FIGS. 1, 2 and 3.

Referring now to FIG. 4, a modification of the lowermost part of the apparatus is illustrated. Here, the wall 4 is directed radially outwardly between the tubes 2 and 3 so that the cavity changes abruptly from a lower, relatively wide portion to the first part *7b* of the upper, relatively narrow section 7. This arrangement is found to work satisfactorily because, it is believed, stone is trapped beneath the wall 4 and this assists in the formation of an arch when compaction forces are applied. The zone marked A and delineated by dashed lines represents the region beneath the wall 4 where stone is friction-locked together.

Figure 5:
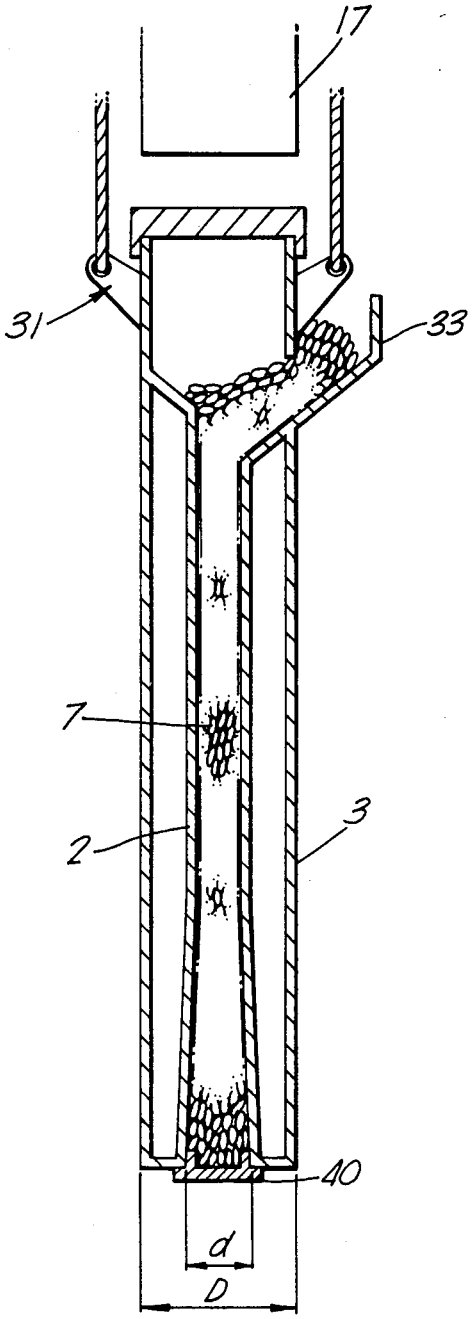
FIG. 5 illustrates a third embodiment of apparatus in accordance with the invention.

Referring now to FIG. 5, a simpler form of construction of apparatus is shown. The upper parts of the apparatus are the same in all essentials as the embodiment shown in FIG. 3; the lower part of the apparatus differs principally in that the connection between the inner tube 2 and the outer tube 3 is a simple annular wall instead of an angled wall; and in that the lower end of the inner tube 2 is closed off by a closure plate 40. The inner tube, in this embodiment, may be cylindrical throughout its length or it may be tapered generally in the manner illustrated in FIG. 3. The closure plate 40 may have centralising ring (not shown) or a similar device attached to it during the driving stage in order to maintain it is position as the apparatus is driven into or against the ground. The plate may be formed of steel or concrete or even of wood or a plastics material; it is regarded as an expendible item and is not recovered when the apparauts is raised during the tamping and extraction stages. The ratio d/D may be varied within fairly wide limits, the ratio in any given case depending, for example, on the degree of column compaction which is sought.

The flat joining piece 4 between inner tube 2 and outer tube 3 functions as a compacting surface when the apparatus is used.

When the apparatus of the invention is used for piling, the external diameter of the outer tube 3 may be smaller—or larger—than the dimensions given above as examples for stone column formation. Typically, the apparatus of the invention may be used to form cast-in-place piles whose diameter is about 250–300 mm. Instead of stone or dry concrete, a granular material such as a coarse sand or dry mortar may be used. Preferably, the top part of any such pile is completed by filling the cavity of the apparatus with wet concrete.

We claim:

1. Apparatus for forming a stone column in the ground, which comprises: a pair of concentric tubes the inner one of which is open at its upper end, and at or near its lower end is integrally connected by an imperforate connecting member to the outer tube; and a driving plate attached at or close to the upper end of one of said inner and outer tubes, so as to extend around said one tube; and driving means for applying a downwardly acting force against said driving plate whereby the apparatus may be driven into or against the ground, and wherein the space within said inner tube defines a cavity for receiving stone.

2. Apparatus as claimed in claim 1, characterised in that the inner tube is open at both ends.

3. Apparatus as claimed in claim 2, wherein the inner tube is connected to said outer tube by a rigid outwardly extending wall portion.

4. Apparatus as claimed in claim 3, wherein said outwardly extending wall portion, that part of said inner tube at the lower end thereof and that portion of said outer tube at the lower end thereof together define said cavity which comprises an upper, relatively narrow portion and a lower, relatively wide portion.

5. Apparatus as claimed in claim 1, wherein said inner tube is closed at its lower end.

6. Apparatus as claimed in claim 4, wherein said driving plate is carried by said outer tube at its upper end.

7. Apparatus as claimed in claim 4, wherein said inner tube extends upwardly beyond the levels of said outer tube and carries, at or near its upper end, an extraction plate.

8. Apparatus as claimed in claim 6 or 7, wherein, said driving means comprises an annular hammer located about the upper region of said inner tube between the driving plate and the extraction plate.

9. Apparatus as claimed in claim 4, wherein said outer tube extends upwardly beyond the level of said inner tube and carries, at or near its upper end, extraction lugs.

10. Apparatus as claimed in claim 9, wherein a hopper is provided for feeding stone into the interior cavity of the apparatus.

11. Apparatus as claimed in claim 9, wherein a region above the upper limit of said inner tube acts as a reservoir for stone.

12. Apparatus as claimed in claim 4, wherein the upper, relatively narrow portion of said cavity comprises an upper cylindrical section and a lower, downwardly and outwardly tapering section.

13. Apparatus for forming a stone column in the ground, which comprises a pair of concentric tubes the inner one of which is open at both ends, and at or near its lower end is integrally connected to the outer tube by an imperforate outwardly extending wall portion; a driving plate attached at or close to the upper end of one of said inner and outer tubes, so as to end around said one tube; and driving means for applying a downwardly acting driving force against said driving plate whereby the apparatus may be driven into or against the ground; wherein the lower portion of said inner tube, said outwardly extending wall portion and the lower portion of said outer tube together define a cavity comprising an upper, relatively narrow portion and a lower, relatively wide portion.

14. A method of forming a stone column, which comprises positioning an apparatus as defined hereinabove at a location where a stone column is to be formed; pre-positioning stone at said location before positioning the apparatus, or adding stone to the interior cavity of the apparatus after it has been positioned at said location; driving the apparatus downwardly to a depth equivalent to the desired depth for the stone column which is to be formed; and thereafter extracting the apparatus in a plurality of stages while delivering stone through the inner tube of the apparatus, and applying to the apparatus between each of the removal stages during extraction a downward force in order to compact stone expelled from the lower end of the apparatus.

15. A method of forming a cast-in-place pile without the use of a pileshoe, which comprises positioning an apparatus as defined hereinabove at a location where a pile is to be formed; pre-positioning dry or nearly dry concrete at said location before positioning the apparatus, or adding dry or nearly dry concrete to the interior cavity of the apparatus after it has been positioned at said location; driving the apparatus downwardly to a depth equivalent to the desired depth for the pile which is to be formed; and thereafter extracting the apparatus in a plurality of stages while delivering dry or nearly dry concrete through the inner tube of the apparatus, and applying to the apparatus between each of the removal stages during extraction a downward force in order to compact the concrete expelled from the lower end of the apparatus.

16. A method according to claim 15, wherein wet concrete is added to the interior cavity of the apparatus to form the upper part of said cast-in-place pile.

* * * * *